US007759878B2

(12) United States Patent
Yufuku et al.

(10) Patent No.: US 7,759,878 B2
(45) Date of Patent: Jul. 20, 2010

(54) LIGHTING DEVICE FOR A HIGH-PRESSURE DISCHARGE LAMP AND LIGHTING EQUIPMENT EMPLOYING SAME

(75) Inventors: Akira Yufuku, Kadoma (JP); Takeshi Goriki, Kadoma (JP); Noriyuki Fukumori, Kadoma (JP); Nobuo Ukita, Himeji (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 732 days.

(21) Appl. No.: 10/578,691

(22) PCT Filed: Nov. 10, 2004

(86) PCT No.: PCT/JP2004/016663

§ 371 (c)(1),
(2), (4) Date: Aug. 7, 2006

(87) PCT Pub. No.: WO2005/046293

PCT Pub. Date: May 19, 2005

(65) Prior Publication Data

US 2007/0103100 A1 May 10, 2007

(30) Foreign Application Priority Data

Nov. 10, 2003 (JP) ..... 2003-380410

(51) Int. Cl.
*H05B 37/02* (2006.01)

(52) U.S. Cl. ..... 315/291; 315/80

(58) Field of Classification Search ..... 315/209 R, 315/276, 291, 307, 308, 224, 225, 80, 82, 315/156–158, DIG. 7
See application file for complete search history.

(56) References Cited

U.S. PATENT DOCUMENTS 4,207,500 A 6/1980 Duve et al.

(Continued)

FOREIGN PATENT DOCUMENTS

AU 698074 10/1998

(Continued)

OTHER PUBLICATIONS

English Language Abstract of JP 6-260289, (Sep. 16, 1994).

(Continued)

*Primary Examiner*—Douglas W Owens
*Assistant Examiner*—Jimmy T Vu
(74) *Attorney, Agent, or Firm*—Greenblum & Bernstein, P.L.C.

(57) ABSTRACT

A lighting device for lighting a high-pressure discharge lamp 2 having an outer tube, an interior of which is substantially under vacuum. The lighting device includes a ballast 3 having at least a current limiting element and a high-voltage pulse generating circuit 4 for generating a high-voltage pulse, and also includes a lighting discriminating means 8 for discriminating between lighting and non-lighting of the discharge lamp 2, a timer circuit 9 for setting a predetermined period of time, and a pulse-stop control means 10 for stopping generation of the high-voltage pulse. When the lighting discriminating means 8 discriminates non-lighting after lighting has been discriminated, generation of the high-voltage pulse is stopped within the predetermined period of time set by the timer circuit 9.

16 Claims, 5 Drawing Sheets

U.S. PATENT DOCUMENTS

| | | | | |
|---|---|---|---|---|
| 5,019,751 | A | 5/1991 | Flory, IV et al. | |
| 5,705,897 | A * | 1/1998 | Hanazaki et al. | 315/307 |
| 5,773,937 | A * | 6/1998 | Miyazaki et al. | 315/246 |
| 5,808,422 | A * | 9/1998 | Venkitasubrahmanian et al. | 315/225 |
| 6,674,248 | B2 * | 1/2004 | Newman et al. | 315/247 |
| 6,794,818 | B1 * | 9/2004 | Myojo et al. | 313/580 |
| 7,368,881 | B2 * | 5/2008 | Suganuma et al. | 315/291 |

FOREIGN PATENT DOCUMENTS

| | | |
|---|---|---|
| AU | 698825 | 11/1998 |
| DE | 19531622 | 3/1997 |
| DE | 19531623 | 3/1997 |
| EP | 1173050 | 1/2002 |
| JP | 5-174985 | 7/1993 |
| JP | 5-225956 | 9/1993 |
| JP | 6-260289 | 9/1994 |
| JP | 6-267678 | 9/1994 |
| JP | 7-272680 | 10/1995 |
| JP | 8-315777 | 11/1996 |
| JP | 10-106767 | 4/1998 |
| JP | 2001-052883 | 2/2001 |
| JP | 2002-352969 | 12/2002 |

OTHER PUBLICATIONS

English Language Abstract of JP 2001-052883, (Feb. 23, 2001).
English Language Abstract of JP 5-225956, (Sep. 3, 1993).
English Language Abstract of JP 2002-352969, (Dec. 6, 2002).
U.S. Appl. No. 11/368,667 to Sun et al., filed Mar. 7, 2006.
U.S. Appl. No. 10/562,217 to Goriki et al., filed Dec. 23, 2005.
English language Abstract of 5-174985, Jul. 13, 1993.
English language Abstract of 10-106767, Apr. 24, 1998.
English language Abstract of 7-272680, Oct. 20, 1995.
English language Abstract of 8-315777, Nov. 29, 1996.
English language Abstract of 6-267678, Sep. 22, 1994.

* cited by examiner

LIGHTING DEVICE FOR A HIGH-PRESSURE DISCHARGE LAMP AND LIGHTING EQUIPMENT EMPLOYING SAME

TECHNICAL FIELD

The present invention relates to a lighting device for lighting a high-pressure discharge lamp and a lighting equipment employing the same.

BACKGROUND ART

Lighting devices of this kind are generally provided with a high-voltage pulse generating circuit that applies a high-voltage pulse to a high-pressure discharge lamp to start the lamp. One example of the lighting devices is depicted in FIG. 5. In this figure, reference numeral 1 denotes an AC power source, reference numeral 2 denotes a high-pressure discharge lamp, reference numeral 3 denotes a ballast, reference numeral 4 denotes a high-voltage pulse generating circuit, reference numeral 5 denotes a pulse transformer, reference numeral 6 denotes a capacitor, and reference numeral 7 denotes a switching element. When the switching element 7 turns from an OFF state to an ON state, a pulse-shaped electric current flows through a primary winding N1 of the pulse transformer 5 via the capacitor 6 and, hence, a pulse-shaped high voltage is generated in a secondary winding N2 of the pulse transformer 5. As a result, insulation of the high-pressure discharge lamp 2 is broken to thereby start discharge. When the high-pressure discharge lamp 2 is turned on, the AC power source 1 supplies the high-pressure discharge lamp 2 with electric power via the ballast 3.

It is known that the high-pressure discharge lamp of this type is hard to be turned on again immediately after it has been turned off, because a high lamp temperature increases the gas pressure inside an arc tube. Accordingly, the user must try the starting for, for example, about 20 minutes. If the high-pressure discharge lamp 2 is not turned on, the switching element 7 repeats ON and OFF and continues generating the high-voltage pulse. It is not preferable to continue the application of the high-voltage pulse, because it sometimes causes noise or gives a stress to circuit elements.

Patent document 1 (Japanese Laid-Open Patent Publication No. 6-260289) discloses that upon setting a delay time depending on the lighting duration, the high-voltage pulse is applied to thereby minimize the time of application of the high-voltage pulse.

On the other hand, in the high-pressure discharge lamp of this type, gas leakage from an inner tube (arc tube) sometimes occurs at the end of the life thereof, and the gas collects in an outer tube of the discharge lamp. In such a case, when a high-voltage pulse is applied, abnormal discharge (discharge in the outer tube) occasionally occurs between metallic elements, which support the arc tube, in the outer tube (see FIG. 6). Under this condition, an outer tube glass or a threaded plug (base) of the discharge lamp comes to have a high temperature, causing an energy loss. Furthermore, when the discharge in the outer tube occurs, the temperature of the metallic elements for supporting the arc tube becomes high and exceeds, in some cases, a thermionic critical temperature at which thermoelectrons are emitted and, hence, discharge is likely to occur at such portions. As a result, when a high-voltage pulse is applied, the discharge starts between the metallic elements for supporting the arc tube, causing abnormal discharge or discharge in the outer tube. Because the construction of Patent document 1 referred to above takes no measures against the discharge in the outer tube, if the discharge lamp is supplied with electricity at the end of the life thereof, there is a good chance that discharge occurs in the outer tube.

Half-wave discharge is another abnormal discharge state that may be foreseen at the end of the life of the high-pressure discharge lamp. This is caused by deterioration of an electrode on one side, which proceeds with the age of the high-pressure discharge lamp. Under such a condition, the lamp current flowing through the high-pressure discharge lamp becomes asymmetric on the positive side and on the negative side, and the high-pressure discharge lamp is in a nearly short-circuit condition on one side and in a nearly no-load condition on the other side. In the case of a copper- or iron-based ballast, a direct current flows therethrough and an electric current more than three times the normal secondary short-circuit current flows through one side polarity, causing deterioration of the ballast. A method of adding the ballast with an element such as a thermal fuse or a thermal protector is known as a countermeasure. However, because the thermal fuse is of a non-return type, once the half-wave discharge occurs in the lamp, the ballast can be no longer used, and because the thermal protector is of a return type, the use thereof results in repetition of ON and OFF and is hence not preferable as a countermeasure.

Patent document 2 (Japanese Laid-Open Patent Publication No. 2002-352969) discloses that upon detection of half-wave discharge, the power supply to the high-pressure discharge lamp from the ballast is once cut off, and the stop of operation of an igniter (high-voltage pulse generating circuit) is maintained by a signal from a cutoff detecting means for detecting cutoff. This construction makes it possible to prevent deterioration of the ballast or repetition of ON and OFF of the high-pressure discharge lamp when half-wave discharge has occurred.

Patent document 1: Japanese Laid-Open Patent Publication No. 6-260289

Patent document 2: Japanese Laid-Open Patent Publication No. 2002-352969

DISCLOSURE OF THE INVENTION

Problems to be Solved by the Invention

However, the above-described construction needs a means for cutting off the power supply. Although a power semiconductor element such as, for example, a thermal protector, a MOSFET or the like can be used for such means, these elements are generally costly and large, resulting in an increase in cost and size of the ballast.

The present invention has been developed to overcome the above-described disadvantages, and an objective of the present invention is to provide a lighting device for a discharge lamp capable of preventing discharge in the outer tube or half-wave discharge, which may be foreseen at the end of the life of a high-pressure discharge lamp, from continuing. Another objective of the present invention is to provide a lighting equipment employing such a lighting device.

Means to Solve the Problems

In accomplishing the above objective, the present invention provides a lighting device for lighting a high-pressure discharge lamp having an outer tube, an interior of which is substantially under vacuum, the lighting device including, as shown in FIG. 1, a ballast 3 having at least a current limiting element and a high-voltage pulse generating circuit 4 for generating a high-voltage pulse. The lighting device is characterized by a lighting discriminating means 8 for discriminating between lighting and non-lighting of the discharge lamp 2, a timer circuit 9 for setting a predetermined period of time, and a pulse-stop control means 10 for stopping generation of the high-voltage pulse, wherein when the lighting discriminating means 8 discriminates non-lighting after lighting has been discriminated, generation of the high-voltage pulse is stopped within the predetermined period of time set by the timer circuit 9.

EFFECTS OF THE INVENTION

According to the present invention, when discharge in the outer tube occurs at the end of the life of the high-pressure discharge lamp, the discriminating means for discriminating between normal lighting and abnormal lighting discriminates abnormal lighting, and generation of the high-voltage pulse is stopped within a predetermined period of time in which metallic elements for supporting the arc tube are cooled below a temperature at which no discharge occurs in the outer tube, thereby preventing discharge in the outer tube from continuing. Furthermore, when half-wave discharge is detected, even if power supply to the high-pressure discharge lamp from the ballast is not cut off, discharge can be stopped merely by stopping generation of the high-voltage pulse in many cases, making it possible to prevent abnormal discharge from continuing.

EXPLANATION OF REFERENCE NUMERALS

1 power source, 2 high-pressure discharge lamp, 3 ballast, 4 high-voltage pulse generating circuit, 5 pulse transformer, 6 capacitor, 7 switching element, 8 lighting discriminating means, 8*a*, 8*b* cutoff detecting means, 9 timer circuit, 10 pulse-stop control means, 11 half-wave discharge detecting means, 12 counter circuit, 13 temperature detecting and cut-off means, 21 outer tube, 22 arc tube, 23, 24 metallic element, 25 stem, 26 base, C1 capacitor, DB1, DB2 full-wave rectifier, PC photo-coupler, Q1, Q2 switching element, R1, R2, R3 resistor.

BEST MODE FOR CARRYING OUT THE INVENTION

Embodiments of the present invention are described hereinafter with reference to the drawings.

Embodiment 1

Figure 1:
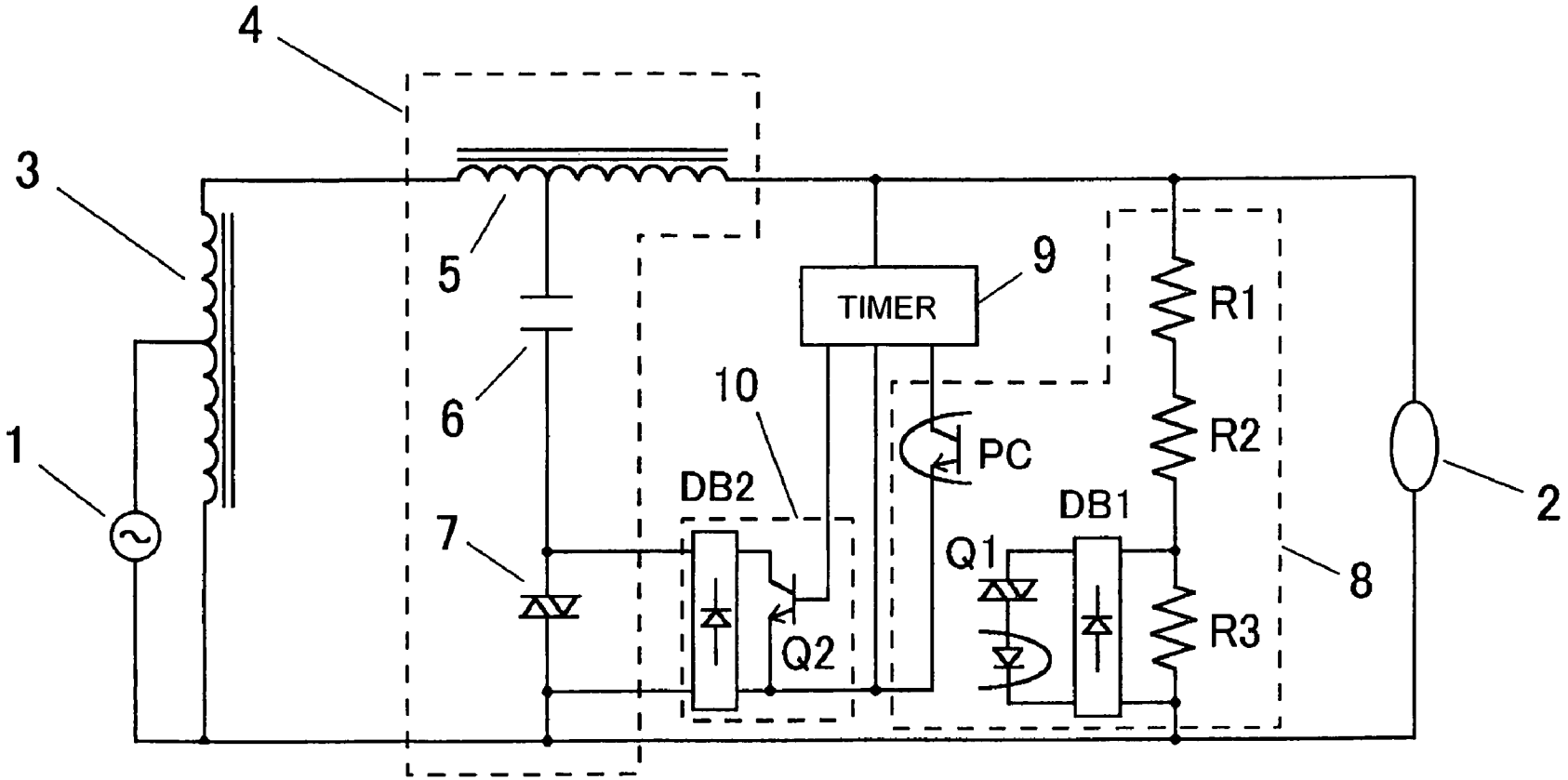
FIG. 1 is a circuit diagram of a lighting device for a high-pressure discharge lamp according to a first embodiment of the present invention.

FIG. 1 depicts a lighting device for a high-pressure discharge lamp according a first embodiment of the present invention. In this embodiment, a lighting discriminating means 8 is connected to opposite ends of a high-pressure discharge lamp 2 to discriminate between normal lighting and abnormal lighting. The lighting discriminating means 8 may be of any construction if it can discriminate abnormal lighting when discharge occurs in an outer tube at the end of the life of the high-pressure discharge lamp 2. In this embodiment, normal lighting and abnormal lighting are discriminated by distinguishing differences in level of a lamp voltage. A series circuit comprised of voltage dividing resistors R1, R2, R3 is connected to the opposite ends of the high-pressure discharge lamp 2 in parallel thereto, and an alternating voltage that is obtained by dividing the lamp voltage is applied to opposite ends of the resistor R3. This alternating voltage is full-wave rectified by a full-wave rectifier DB1, and a rectified output is applied, via a switching element Q1 of a voltage response type, to a light emitting diode of a photo-coupler PC that is an insulated type signal transmitting means. The voltage dividing ratio of the voltage dividing resistors R1, R2, R3 is so set that the voltage applied between opposite ends of the resistor R3 may not exceed a breakover voltage of the voltage response switching element Q1 during normal lighting. When the lamp voltage is higher than that at the normal lighting, the voltage response switching element Q1 breakovers and an electric current flows through the light emitting diode of the photo-coupler PC being the insulated type signal transmitting means to generate a light signal. Upon receipt of this light signal, a light receiving diode of the photo-coupler PC conducts an electric current, thereby causing the lighting discriminating means 8 to output a discrimination signal indicative of abnormal lighting.

When abnormal lighting is detected, the discrimination signal is transmitted to a timer circuit 9 so that a pulse-stop control means 10 can stop a high-voltage pulse within a predetermined period of delay time. The pulse-stop control means 10 may be of any construction if it can deactivate the high-voltage pulse generating circuit 4. In this embodiment, the generation of the high-voltage pulse is stopped by short-circuiting opposite ends of a switching element 7. That is, an AC terminal side of a full-wave rectifier DB2 is connected to opposite ends of the switching element 7, while a switching element Q2 for short-circuit use is connected to a DC terminal side of the full-wave rectifier DB2, and the switching element Q2 is kept on within a predetermined period of delay time in response to an output from the timer circuit 9. By so doing, a charge and discharge current of a capacitor 6 is prevented, just as the switching element 7 is turned on, from flowing as a pulse current and, hence, no high-voltage pulse is generated. Although in this embodiment a bipolar transistor is employed as the switching element Q2, a MOSFET may be used. When the switching element Q2 is turned off after a lapse of the delay time of the timer circuit 9, the opposite ends of the switching element 7 are opened. The switching element 7 is a voltage response type switching element, and when a superimposed voltage of a voltage of an AC power source and a charging voltage of the capacitor 6 exceeds the breakover voltage of the switching element 7 due to periodic reversal of polarity of an AC power source 1, the switching element 7 is turned on to thereby allow the charge and discharge current of the capacitor 6 to flow through a primary winding of a pulse transformer 5 as a pulse current, resulting in generation of a high-voltage pulse.

When the lighting discriminating means 8 discriminates abnormal lighting (including non-lighting) after it has discriminated normal lighting, the timer circuit 9 acts to maintain the switching element Q2 of the pulse-stop control means 10 in an ON state within the predetermined period of delay time. It is possible to determine that normal lighting has been established, for example, when a state below a rated lamp voltage has continued for about thirty seconds. Thereafter, if the lamp voltage increases abnormally over the rated lamp voltage, it is possible to determine that an abnormal lighting state such as discharge in the outer tube has arisen or non-lighting (no-load state) has arisen due to lighting failure. Accordingly, upon appropriately setting the voltage dividing ratio of the voltage dividing resistors R1-R3 of the lighting discriminating means 8, if a state where an abnormality discriminating signal (ON signal of photo-coupler PC) from the lighting discriminating means 8 is not inputted to the timer circuit 9 continues for about thirty seconds after the lighting device has been powered on, it is determined that the high-pressure discharge lamp 2 has entered into a normal lighting state. Thereafter, when the abnormality discriminating signal (ON signal of photo-coupler PC) from the lighting discriminating means 8 is inputted to the timer circuit 9, the timer circuit 9 outputs an ON signal to the switching element Q2 until the predetermined period of delay time elapses.

The period of delay time of the timer circuit 9 is set to a period of time within which the temperature of metallic elements for supporting the arc tube in the outer tube becomes below the thermionic critical temperature, and varies depending on the specification of the discharge lamp or the radiating structure of the lighting device. However, the period of delay time is generally set to an optimum value (for example, about four minutes) in the range of about two to ten minutes, more preferably in the range of about three to five minutes. Of terminals of the timer circuit 9, a terminal connected to the light receiving element of the photo-coupler PC is an input terminal, a terminal connected to a base of the transistor Q2 is an output terminal, a terminal connected to an emitter of the transistor Q2 is a ground terminal, and a terminal connected to the pulse transformer 5 and to the high-pressure discharge lamp 2 is a power terminal.

The above-described construction makes it possible to prevent discharge in the outer tube, which may be foreseen at the end of the life of the high-pressure discharge lamp, from continuing by discriminating between normal lighting and abnormal lighting of the high-pressure discharge lamp 2.

Although in the above-described embodiment the lighting discriminating means 8 has been described as discriminating abnormal lighting upon voltage detection, the use of a current transformer is also possible to discriminate abnormal lighting upon current detection. The timer circuit 9 can be constituted by a microcomputer (for example, TMC47C243M manufactured by TOSHIBA) or the like.

Because it is preferred in many cases that the generation of the high-voltage pulse be resumed when the power supply is turned on again, an output of the lighting discriminating means or the timer circuit is preferably reset (returned to an initial condition) with power cutoff.

Embodiment 2

Figure 2:
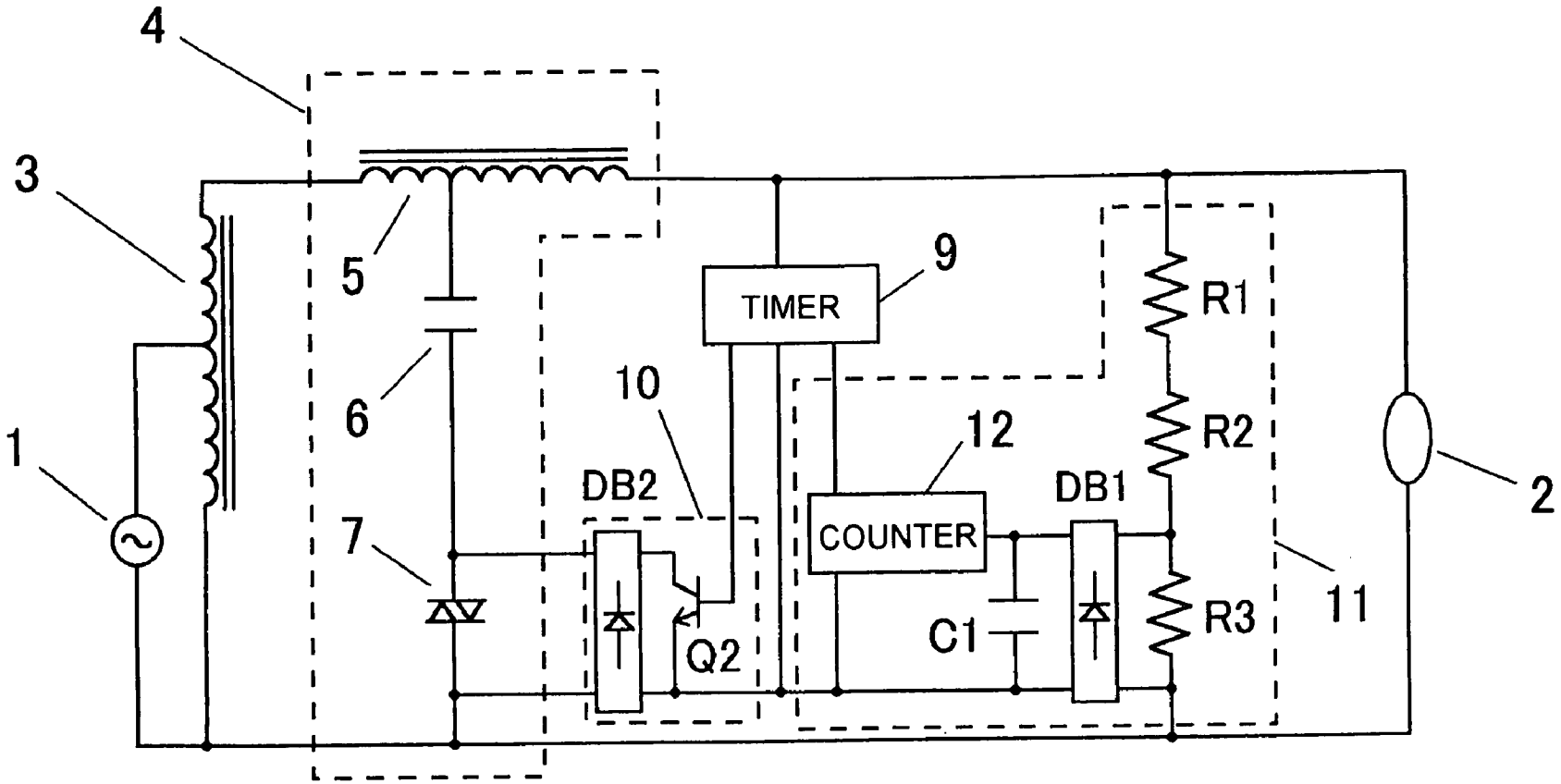
FIG. 2 is a circuit diagram of a lighting device for a high-pressure discharge lamp according to a second embodiment of the present invention.

FIG. 2 depicts a lighting device for a high-pressure discharge lamp according to a second embodiment of the present invention, which includes a ballast 3 including at least a current limiting element and a high-voltage pulse generating circuit 4 for generating a high-voltage pulse. This lighting device is used to light a high-pressure discharge lamp 2 having an outer tube, the interior of which is substantially under vacuum. The lighting device also includes a half-wave discharge detecting means 11 for detecting half-wave discharge of the discharge lamp 2 and a pulse-stop control means 10 for stopping generation of the pulse voltage. When the half-wave discharge detecting means 11 detects half-wave discharge, the pulse-stop control means 10 stops generation of the high-voltage pulse. The lighting device further includes a timer circuit 9 for setting a predetermined period of time. When the half-wave discharge detecting means 11 detects half-wave discharge, generation of the high-voltage pulse is stopped within the period of time set by the timer circuit 9.

The half-wave discharge detecting means 11 detects a difference in lamp waveform (lamp current or lamp voltage) for every half period and determines the presence of half-wave discharge when the detected value has exceeded a predetermined value. In this embodiment, the half-wave discharge detecting means 11 is connected to opposite ends of the high-pressure discharge lamp 2 to detect half-wave discharge. As described hereinabove, a half-wave discharge phenomenon occurs due to deterioration of an electrode on one side with the age of the high-pressure discharge lamp. Under such condition, the lamp current flowing through the high-pressure discharge lamp becomes asymmetric on the positive side and on the negative side, and the high-pressure discharge lamp is in a nearly short-circuit condition on one side and in a nearly no-load condition on the other side. Accordingly, half-wave discharge can be discriminated by detecting that the lamp current is flowing asymmetrically on the positive and negative sides, but in the circuit of FIG. 2 half-wave discharge is discriminated by detecting that the lamp voltage has become asymmetric on the positive and negative sides. That is, because the lamp voltage becomes low on one polarity side on which the high-pressure discharge lamp 2 is in a nearly short-circuit condition, while the lamp voltage becomes high on the other polarity side on which the high-pressure discharge lamp 2 is in a nearly no-load condition, the half-wave discharge is detected by discriminating between such conditions.

Figure 3:
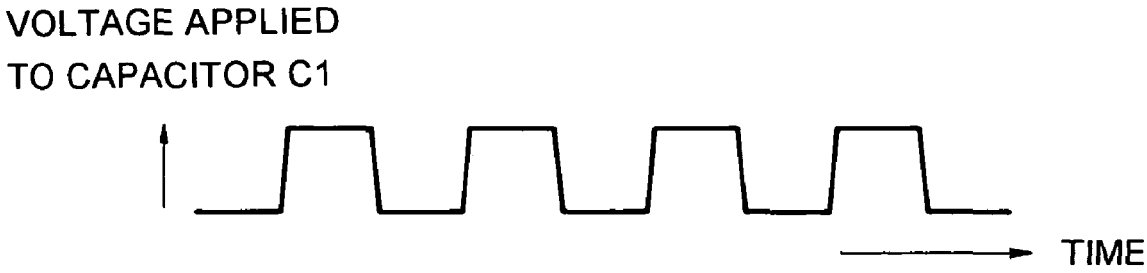
FIG. 3 is a waveform diagram indicating the operation of the lighting device for the high-pressure discharge lamp of FIG. 2.

More specifically, a series circuit comprised of voltage dividing resistors R1, R2, R3 is connected to opposite ends of the high-pressure discharge lamp 2 in parallel thereto, and a voltage applied between opposite ends of the resistor R3 is full-wave rectified by a full-wave rectifier DB1 and is then smoothed by a small capacity capacitor C1. A voltage waveform smoothed by the capacitor C1 is inputted to a counter circuit 12. The time constant of the capacity of the capacitor C1 and the discharge resistance thereof (not shown) is set to be shorter than the period of an AC power source 1, and in the case of half-wave discharge, an input waveform of the counter circuit 12 takes the form of a pulse as shown in FIG. 3, the number of which is counted by the counter circuit 12. When a total of the number counted reaches a predetermined number, it is determined that half-wave discharge has occurred, and an abnormality discriminating signal is inputted to a timer circuit 9, which in turn causes a pulse-stop control means 10 to stop generation of a high-voltage pulse within a predetermined period of delay time.

Studies of the inventors of this application have revealed that in the case of high-pressure discharge lamps in which half-wave discharge occurs, almost all the discharge lamps cannot maintain lighting, but cause lighting failure by stopping the application of the pulse during the half-wave discharge. Accordingly, the above-described construction makes it possible to prevent a half-wave discharge phenomenon, which may be foreseen at the end of the life of the high-pressure discharge lamp, from continuing.

Although in this embodiment the half-wave discharge detecting means has been described as detecting the voltage, the use of a current transformer is also possible to discriminate abnormal lighting upon current detection. The timer circuit 9 can be constituted by a microcomputer (for example, TMC47C243M manufactured by TOSHIBA) or the like.

Because it is preferred in many cases that the generation of the high-voltage pulse be resumed when the power supply is turned on again, an output of the half-wave discharge detecting means or the timer circuit is preferably reset with power cutoff.

Embodiment 3

Figure 4:
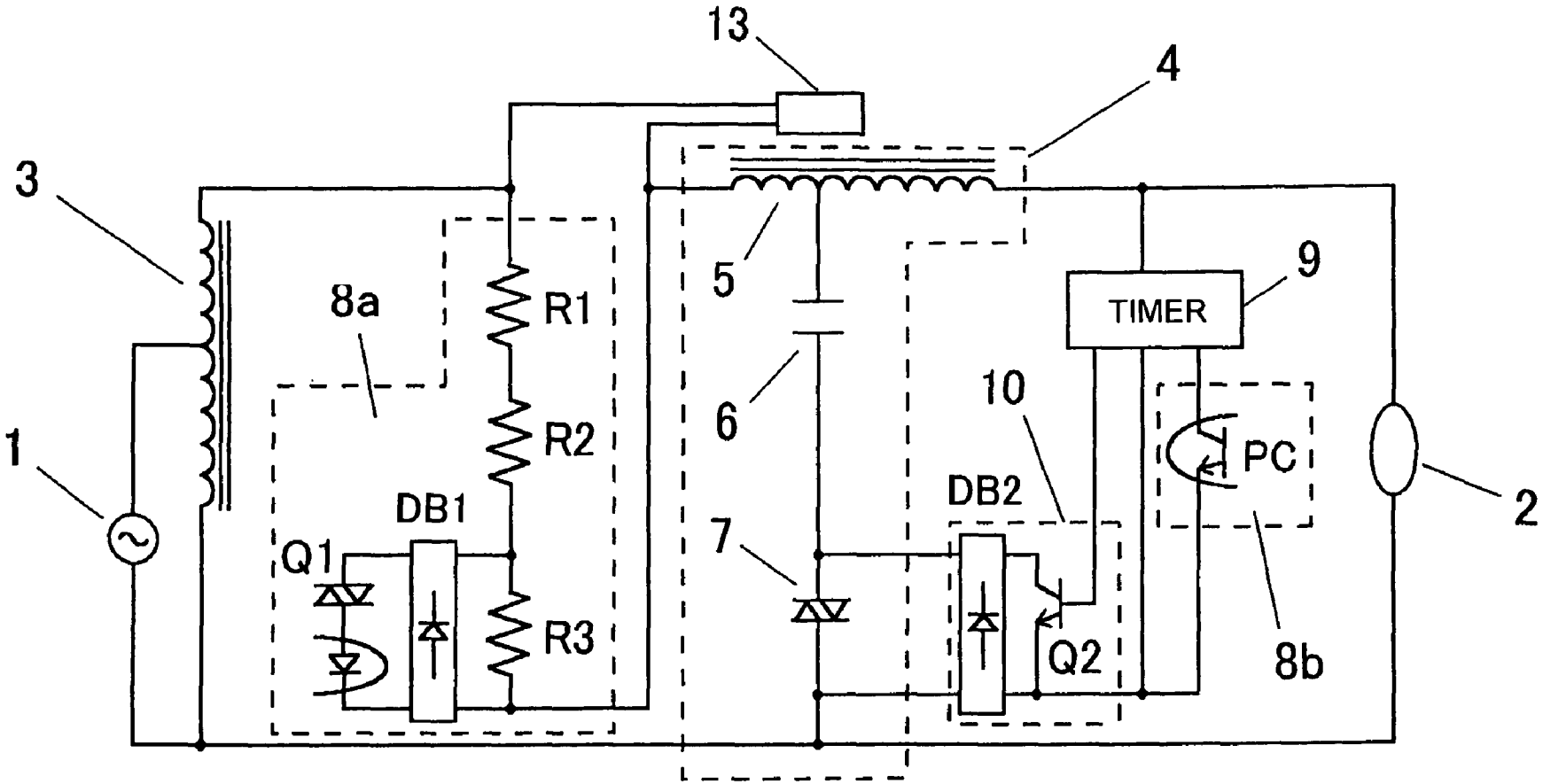
FIG. 4 is a circuit diagram of a lighting device for a high-pressure discharge lamp according to a third embodiment of the present invention.
Figure 5:
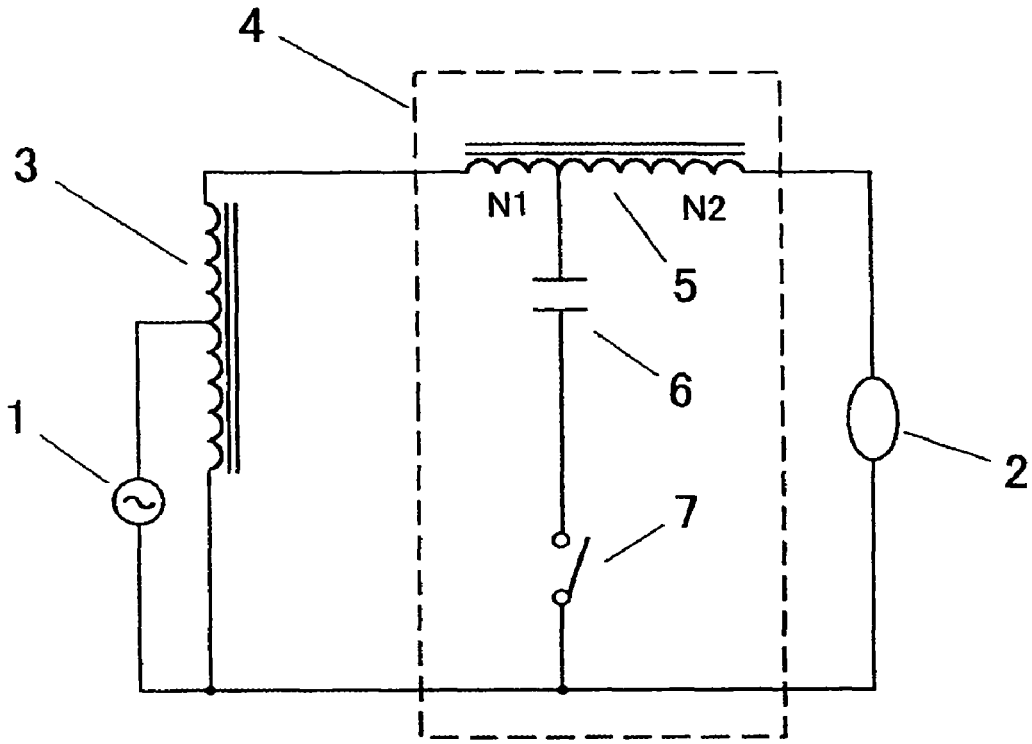
Fig. 5 PRIOR ART
FIG. 5 is a circuit diagram of a conventional lighting device for a high-pressure discharge lamp.

FIG. 4 depicts a lighting device for a high-pressure discharge lamp according to a third embodiment of the present invention, which includes a ballast 3 including at least a current limiting element and a high-voltage pulse generating circuit 4 for generating a high-voltage pulse. This lighting device is used to light a high-pressure discharge lamp 2 having an outer tube, the interior of which is substantially under vacuum. The lighting device also includes a timer circuit 9 for setting a predetermined period of time, a return type temperature detecting and cutoff means 13 for detecting an abnormal temperature rise to thereby cut off power supply to the discharge lamp, and cutoff detecting means 8*a*, 8*b* for detecting such cutoff. When the cutoff is detected by the cutoff detecting means 8*a*, 8*b*, generation of the high-voltage pulse is stopped within the period of time set by the timer circuit 9.

In this embodiment, the temperature of a pulse transformer 5 is monitored by the temperature detecting and cutoff means 13, which is an automatic-reset one such as a thermal protector. The temperature detecting and cutoff means 13 cuts off electricity when an abnormal temperature rise is detected, and is reset automatically to resume conducting electricity upon reduction of the detected temperature.

Once the temperature detecting and cutoff means 13 enters into a state of cutoff, even if it is automatically reset to resume conducting electricity, the pulse-stop control means 10 stops generation of the high-voltage pulse within the predetermined period of delay time set by the timer circuit 9. Because the delay time of the timer circuit 9 is set to be longer than a period of time required for the automatic reset of the thermal protector, frequent repetition of lighting and non-lighting does not occur. Accordingly, when the discharge lamp is turned on again, the temperature of metallic elements that support an arc tube in an outer tube drops below a thermionic critical temperature, making it possible to prevent an abnormal discharge state from continuing.

In many cases, the temperature detecting and cutoff means such as the thermal protector utilizes a simple mechanism such as, for example, a bimetal in which when the ambient temperature increases abnormally, deformation of the bimetal opens a contact, while when the ambient temperature decreases, restoration of the bimetal closes the contact. For this reason, such a temperature detecting and cutoff means is not provided with a signal output terminal through which the state of cutoff is transmitted to the outside. In this embodiment, when the temperature detecting and cutoff means 13 detects an abnormal temperature and enters into the state of cutoff, the cutoff detecting means 8*a*, 8*b* act to trigger the time circuit 9. The cutoff detecting means 8*a*, 8*b* have a construction similar to the construction of the lighting discriminating means 8 explained with reference to FIG. 1, and acts to transmit an abnormality discriminating signal to the timer circuit 9 via a photo-coupler PC when the AC voltage applied to the voltage dividing resistors R1-R3 is high.

More specifically, when the temperature of the pulse transformer 5 is in a normal temperature range, the temperature detecting and cutoff means 13 such as the thermal protector is in a state of conducting electricity, and a voltage response type switching element Q1 of the cutoff detecting means 8*a* is in an OFF state.

Thereafter, when the temperature of the pulse transformer 5 falls within an abnormal temperature range, the temperature detecting and cutoff means 13 such as the thermal protector enters into a state of not conducting electricity, and the discharge lamp 2 is turned off. At this moment, a voltage is applied to a path from the AC power source 1 back to the AC power source via the ballast 3, the voltage dividing resistors R1, R2, R3, the primary and second windings of the pulse transformer 5, a power terminal and a ground terminal of the timer circuit 9, and a diode of the full-wave rectifier DB2, thus increasing the voltage between opposite ends of the resistor R3. As a result, the voltage response type switching element Q1 is turned on, and an abnormality discriminating signal is transmitted to the timer circuit 9 via the photo-coupler PC that is an insulated type signal transmitting means. This activates the timer circuit 9, which in turn causes the pulse-stop control means 10 to stop generation of the high-voltage pulse within the predetermined period of delay time. As described hereinabove, the period of delay time is set to about three to five minutes and, hence, no high-voltage pulse is generated until the temperature of the metallic elements for supporting the arc tube in the outer tube becomes below the thermionic critical temperature.

Although the temperature detecting and cutoff means 13 returns to the state of conducting electricity when the temperature of the pulse transformer 5 falls within the normal temperature range again, the timer circuit 9 already starts its operation at that moment. Because no high-voltage pulse is generated insofar as the switching element Q2 of the pulse-stop control means 10 is maintained in an ON state, the discharge lamp 2 is not turned on. When the temperature detecting and cutoff means 13 returns to the state of conducting electricity upon release of the state of cutoff, the cutoff detecting means 8*a*, 8*b* stops generation of the abnormality discriminating signal, but because the timer circuit 9 already starts the clocking operation, the switching element Q2 of the pulse-stop control means 10 is maintained in the ON state.

Upon completion of the counting operation by the timer circuit 9, when the period of delay time (about three to five minutes) elapses, the switching element Q2 of the pulse-stop control means 10 enters into the OFF state, allowing the high-voltage pulse generating circuit 4 to generate the high-voltage pulse. At this moment, the temperature of the metallic elements for supporting the arc tube in the outer tube becomes below the thermionic critical temperature, making it possible to prevent discharge in the outer tube, which may be foreseen at the end of the life of the high-pressure discharge lamp, from continuing.

Although in this embodiment a thermal protector is employed as the temperature detecting and cutoff means 13, a resistive element having a resistance that increases abruptly over the Curie point, like a thermistor having non-linear positive temperature characteristics, may be used as the temperature detecting and cutoff means 13.

Although in this embodiment the cutoff detecting means 8*a*, 8*b* has been described as detecting the voltage, the use of a current transformer is also possible to detect cutoff upon current detection. The timer circuit 9 can be constituted by a microcomputer (for example, TMC47C243M manufactured by TOSHIBA) or the like.

Because it is preferred in many cases that the generation of the high-voltage pulse be resumed when the power supply is turned on again, an output of the cutoff detecting means or the timer circuit is preferably reset with power cutoff.

Although the timer circuit 9 of FIG. 1, FIG. 2 or FIG. 4 has been explained as clocking a predetermined period of delay time after an abnormality discriminating signal has been inputted first, a retriggerable timer circuit that clocks the predetermined period of delay time after the abnormality discriminating signal has been inputted lastly may be also used.

Figure 6:
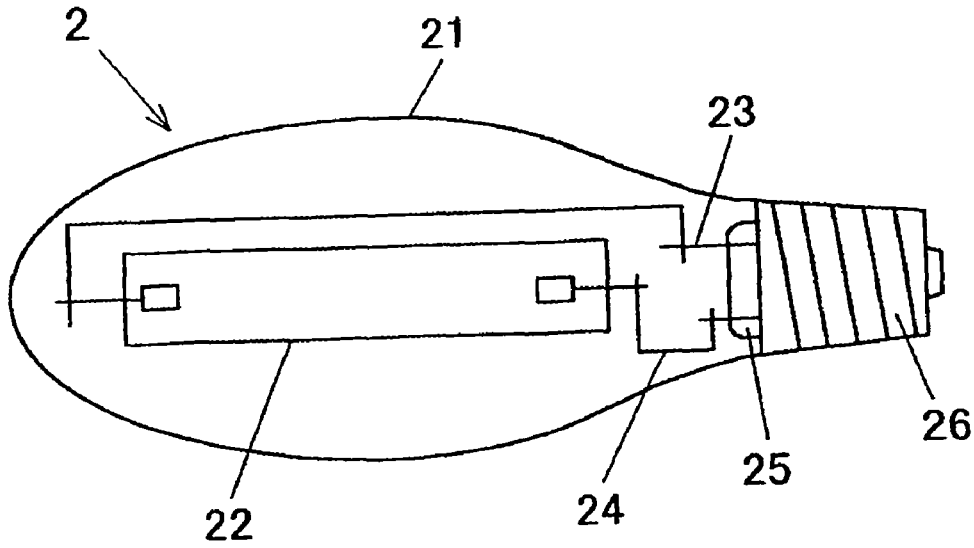
Fig. 6 PRIOR ART
FIG. 6 is a schematic view depicting a construction of a high-pressure discharge lamp.

FIG. 6 depicts a construction of a high-pressure discharge lamp that is turned on or off by the lighting device according to the present invention. In this figure, reference numeral 2 denotes a high-pressure discharge lamp, reference numeral 21 denotes an outer tube, reference numeral 22 denotes an arc tube (inner tube), reference numerals 23 and 24 denote metallic elements of opposite polarities, reference numeral 25 denotes a stem (made of glass), and reference numeral 26 denotes a base (threaded plug). The interior of the outer tube 21 is substantially under vacuum, and even if the arc tube (inner tube) 22 breaks, a high-pressure discharge gas is diluted with a vacuum inside the outer tube 21 and, hence, the outer tube 21 does not break. On the other hand, if the discharge gas leaks gradually from the arc tube (inner tube) at the end of the life, the discharge gas that has leaked out to the outer tube 21 allows discharge to readily occur between the metallic elements 23, 24. When the high-pressure discharge lamp of such a construction is turned on, the present invention can prevent discharge in the outer tube from occurring continuously at the end of the life.

Although a construction of a lighting equipment having such a high-pressure discharge lamp as a light source is not particularly depicted, the lighting equipment includes, for example, a reflector disposed behind the outer tube 21 of the high-pressure discharge lamp 2 to determine the light distribution characteristics, a globe disposed in front of the outer tube 21 of the high-pressure discharge lamp 2, a socket on which the base (threaded plug) 26 of the high-pressure discharge lamp 2 is mounted, and any one of the lighting devices (FIG. 1, FIG. 2, FIG. 4) located between the socket and the AC power source 1.

INDUSTRIAL APPLICABILITY

The present invention can be utilized in, for example, lighting equipments for facilities, street lights, and the like in which a high-pressure discharge lamp is employed.

The invention claimed is:

1. A lighting device for lighting a high-pressure discharge lamp having an outer tube, an interior of which is substantially under vacuum, the lighting device comprising:

a ballast having at least a current limiting element;

a high-voltage pulse generating circuit operable to generate a high-voltage pulse;

a lighting discriminator operable to discriminate between lighting and non-lighting of the discharge lamp;

a timer circuit operable to set a predetermined period of time; and a pulse-stop controller operable to stop generation of the high-voltage pulse;

wherein when the lighting discriminator discriminates non-lighting after lighting has been discriminated, generation of the high-voltage pulse is stopped within the predetermined period of time set by the timer circuit, the discharge lamp further has an arc tube sealed in the outer tube and metallic elements disposed in the outer tube and outside the arc tube, and the predetermined period of time set by the timer circuit is a period of time within which the metallic elements are cooled below a temperature at which no discharge occurs between opposite polarities of the metallic elements.

2. The lighting device according to claim 1, wherein the lighting discriminator is reset with power cutoff.

3. The lighting device according to claim 1, wherein the timer circuit comprises a microcomputer.

4. A lighting equipment having a lighting device according to claim 1.

5. A lighting device for lighting a high-pressure discharge lamp having an outer tube, an interior of which is substantially under vacuum, the lighting device comprising:

a ballast having at least a current limiting element;

a high-voltage pulse generating circuit operable to generate a high-voltage pulse;

a half-wave discharge detector operable to detect half-wave discharge of the discharge lamp; and a pulse-stop controller operable to stop generation of the high-voltage pulse;

wherein when the half-wave discharge detector detects half-wave discharge, the pulse-stop controller stops generation of the high-voltage pulse.

6. The lighting device according to claim 5, further comprising a timer circuit operable to set a predetermined period of time, wherein when the half-wave discharge detector detects half-wave discharge, generation of the high-voltage pulse is stopped within the predetermined period of time set by the timer circuit.

7. The lighting device according to claim 6, wherein the discharge lamp further has an arc tube sealed in the outer tube and metallic elements disposed in the outer tube and outside the arc tube, and wherein the predetermined period of time set by the timer circuit is a period of time within which the metallic elements are cooled below a temperature at which no discharge occurs between opposite polarities of the metallic elements.

8. The lighting device according to claim 6, wherein the timer circuit comprises a microcomputer.

9. The lighting device according to claim 5, wherein the half-wave discharge detector detects a difference in lamp waveform for every half period and determines presence of half-wave discharge when the detected value has exceeded a predetermined value.

10. The lighting device according to claim 5, wherein the half-wave discharge detector is reset with power cutoff.

11. A lighting equipment having a lighting device according to claim 5.

12. A lighting device for lighting a high-pressure discharge lamp having an outer tube, an interior of which is substantially under vacuum, the lighting device comprising:

a ballast having at least a current limiting element;

a high-voltage pulse generating circuit operable to generate a high-voltage pulse;

a timer circuit operable to set a predetermined period of time;

a return type cutoffer operable to cut off power supply to the discharge lamp upon detection of an abnormal temperature rise; and a cutoff detector operable to detect cutoff;

wherein the cutoff detector detects the cutoff, generation of the high-voltage pulse is stopped within the predetermined period of time set by the timer circuit, the discharge lamp further has an arc tube sealed in the outer tube and metallic elements disposed in the outer tube and outside the arc tube, and the predetermined period of time set by the timer circuit is a period of time within which the metallic elements are cooled below a temperature at which no discharge occurs between opposite polarities of the metallic elements.

13. The lighting device according to claim 12, wherein the return type cutoffer comprises a thermal protector.

14. The lighting device according to claim 12, wherein the cutoff detector is reset with power cutoff.

15. The lighting device according to claim 12, wherein the timer circuit comprises a microcomputer.

16. A lighting equipment having a lighting device according to claim 12.

* * * * *